US007758480B1

(12) United States Patent
Chen et al.

(10) Patent No.: US 7,758,480 B1
(45) Date of Patent: Jul. 20, 2010

(54) EXERCISE HOOP

(75) Inventors: I-Huang Chen, No. 66, Alley 71, Lane 252, Sec. 2, Jieshou Rd., Pateh, Taoyuan Hsien (TW); Chang Feng Lin, 4F., No. 76, Daxin St., Yonghe, Taipei Hsien (TW)

(73) Assignees: I-Huang Chen (TW); Chang Feng Lin (TW)

( * ) Notice: Subject to any disclaimer, the term of this patent is extended or adjusted under 35 U.S.C. 154(b) by 0 days.

(21) Appl. No.: 12/358,909

(22) Filed: Jan. 23, 2009

(51) Int. Cl.
*A63B 21/22* (2006.01)
*A63B 21/065* (2006.01)

(52) U.S. Cl. ..... 482/110; 482/105

(58) Field of Classification Search ..... 482/93, 482/110, 122, 124, 129, 105, 130; 446/236
See application file for complete search history.

(56) References Cited

U.S. PATENT DOCUMENTS 3,342,482 A * 9/1967 Paolone ..... 482/110
3,532,340 A * 10/1970 Nardiello ..... 482/124
4,674,987 A * 6/1987 Sober ..... 446/170
4,799,667 A * 1/1989 Suchy ..... 472/17
5,407,405 A * 4/1995 Oren ..... 482/50
5,823,846 A * 10/1998 Arriola et al. ..... 446/236
6,053,846 A * 4/2000 Lin ..... 482/44
6,217,482 B1 * 4/2001 Yoo et al. ..... 482/10
6,733,427 B1 * 5/2004 He ..... 482/122
6,814,645 B2 * 11/2004 Kuk ..... 446/236
7,056,269 B2 * 6/2006 Cleveland et al. ..... 482/148
2009/0270232 A1 * 10/2009 Albanese ..... 482/105

* cited by examiner

*Primary Examiner*—Fenn C Mathew

(57) ABSTRACT

An exercise hoop has an outer loop, an inner loop and an adjustable centrifugal weight assembly. The inner loop is mounted rotatably in the outer loop. The adjustable centrifugal weight assembly is connected pivotally to the inner loop. The weight of the adjustable centrifugal weight assembly may be increased or decreased depending on different users. A beginner may use less weight and a skilled user more for tailored exercise.

9 Claims, 9 Drawing Sheets

EXERCISE HOOP

BACKGROUND OF THE INVENTION

1. Field of the Invention

The present invention relates to an exercise hoop, and more particularly to an exercise hoop that has an adjustable centrifugal weight assembly so a centrifugal load of the exercise hoop may be adjusted to achieve excellent exercising effect.

2. Description of Related Art

Conventional exercise hoops are set loosely around a person's waist and rotated by the person swaying for improved muscle definition and prevent fat accumulation.

However the conventional exercise hoop has following defects.

The exercise hoop lacks positioning functions to securely position itself on the person's waist. Therefore, beginners incapable of swaying correctly cannot stably maintain the exercise hoop on their waist and become frustrated easily.

Furthermore, due to even weight distribution of the exercise hoop, skilled users need not apply strenuous effort so cannot exercise efficiently without further adding weight to the exercise hoop.

Moreover, the exercise hoop constantly hits and rubs against the person's waist and may injure the waist.

To overcome the shortcomings, the present invention provides an exercise hoop to mitigate or obviate the aforementioned problems.

SUMMARY OF THE INVENTION

The main objective of the invention is to provide an exercise hoop that has an adjustable centrifugal weight assembly so a centrifugal load of the exercise hoop may be adjusted to achieve excellent exercising effect.

An exercise hoop in accordance with the present invention comprises an outer loop, an inner loop and an adjustable centrifugal weight assembly. The inner loop is mounted rotatably in the outer loop. The adjustable centrifugal weight assembly is connected pivotally to the inner loop. The weight of the adjustable centrifugal weight assembly may be increased or decreased depending on different users. A beginner may use less weight and a skilled user more for tailored exercising.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
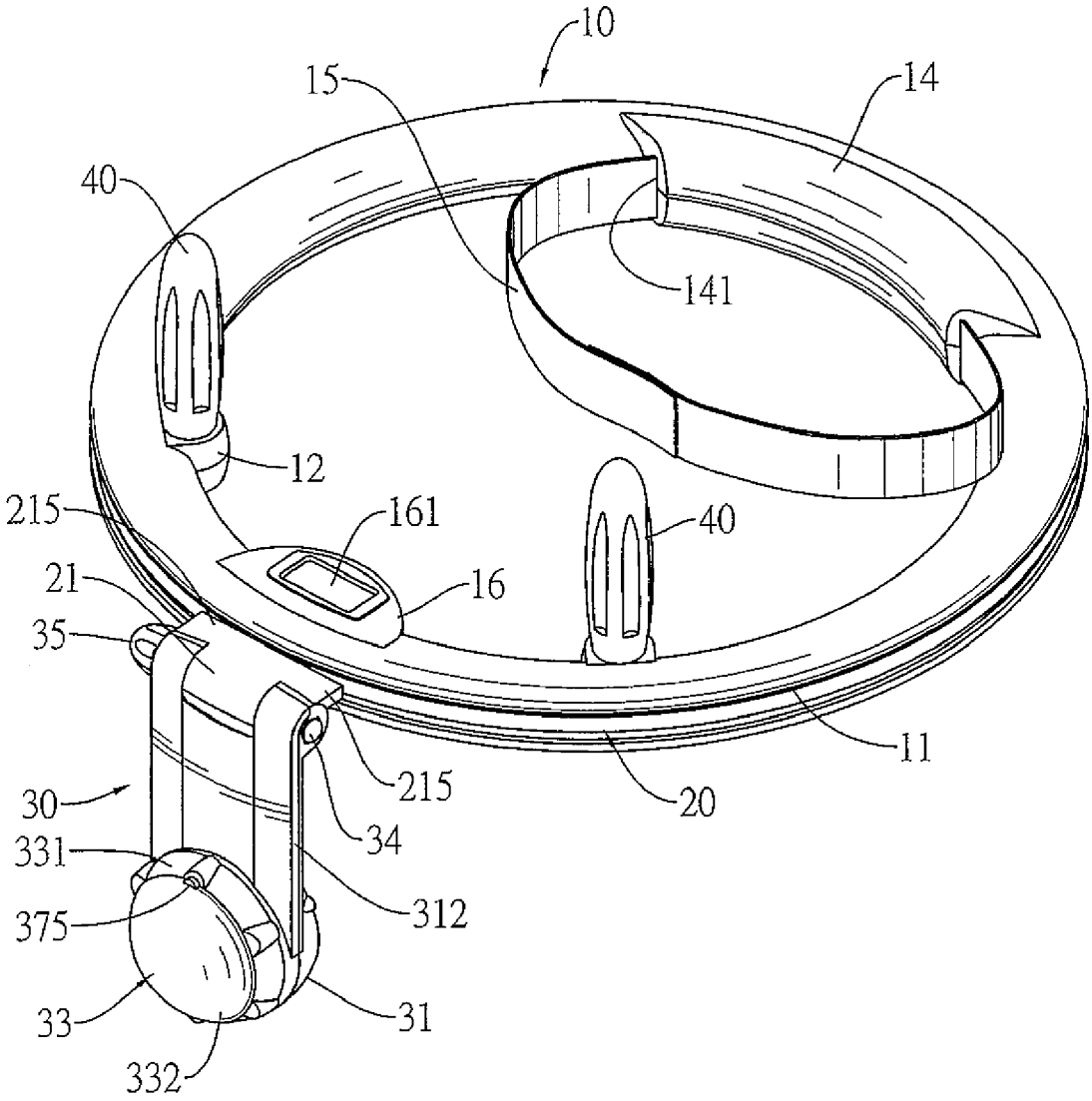
FIG. 1 is a perspective view of an exercise hoop in accordance with the present invention.
Figure 2:
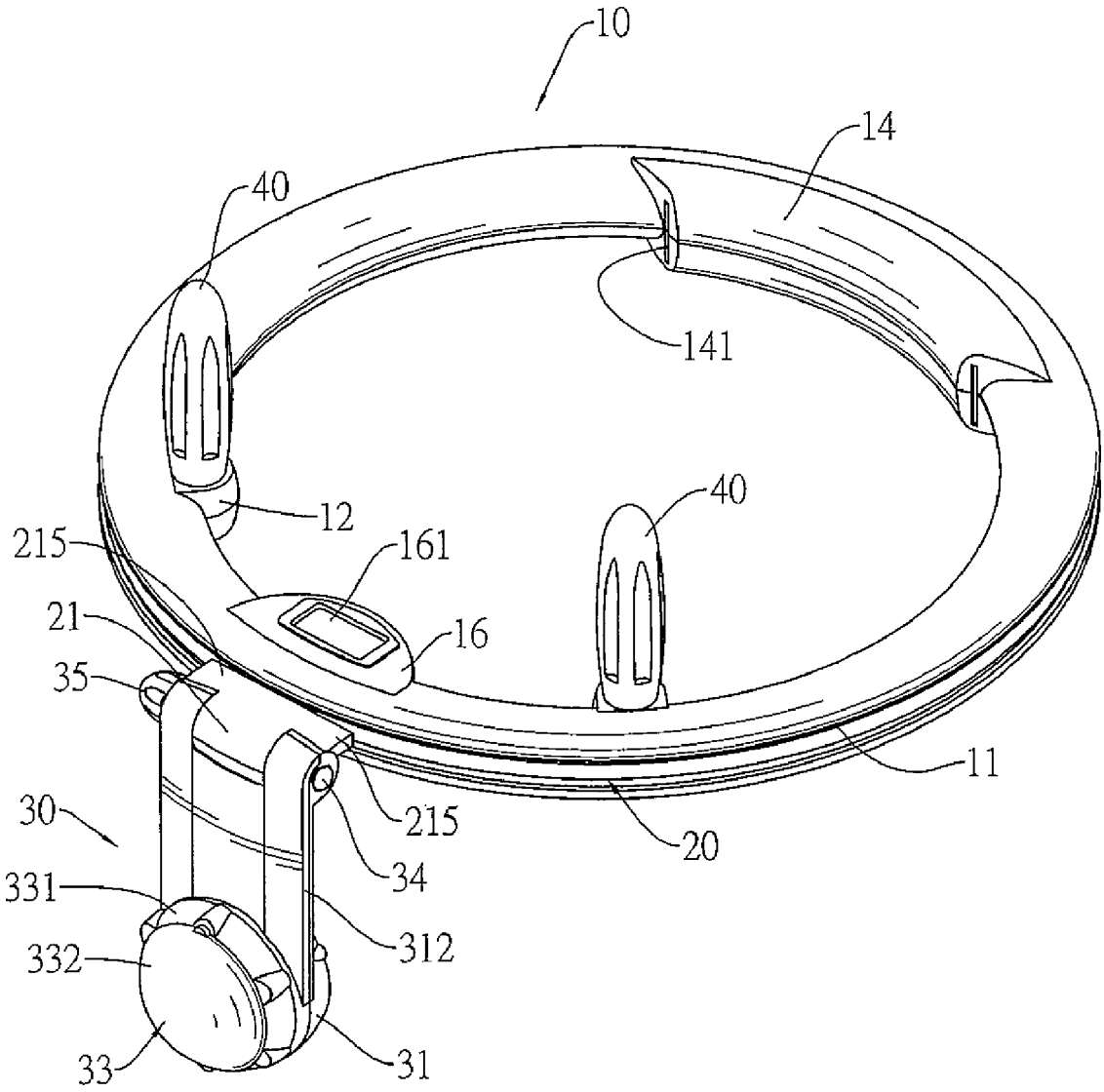
FIG. 2 is another perspective view of the exercise hoop in FIG. 1 without the waist belt.
Figure 9:
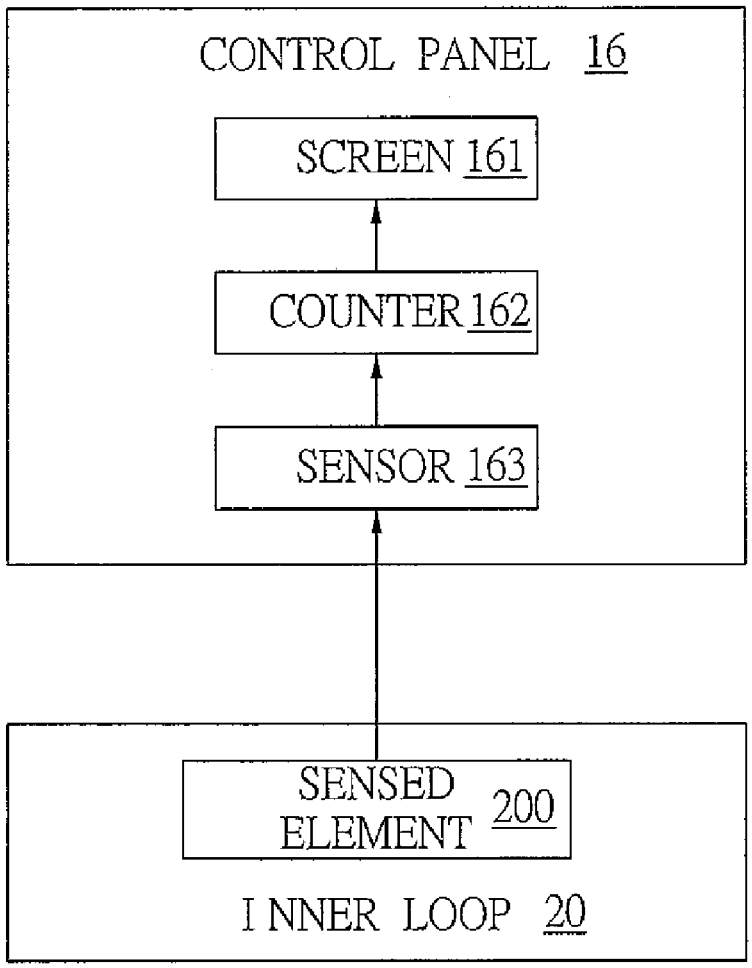
FIG. 9 is a block diagram of a control panel on the outer loop and the inner loop of the exercise hoop in FIG. 2.

With reference to FIGS. 1, 2 and 9, an exercise hoop in accordance with the present invention comprises an outer loop (10), an inner loop (20), an adjustable centrifugal weight assembly (30) and at least one handle (40).

The outer loop (10) has an outside surface, an inside surface and an annular groove (11) and may further have at least one handle mount (12), a belt mount (14), a waist belt (15) and a control panel (16).

Figure 5:
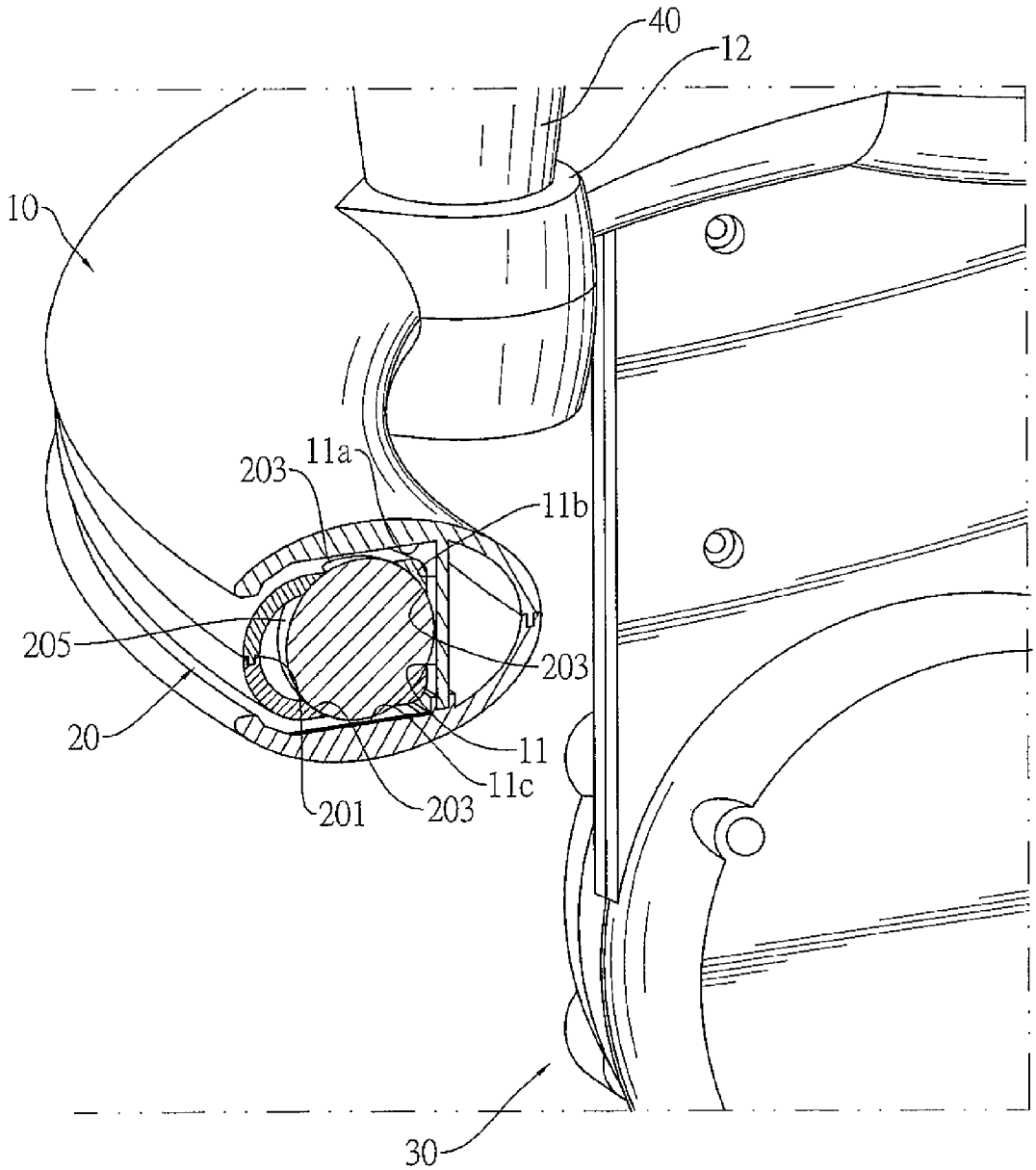
FIG. 5 is an enlarged perspective view in partial section of the exercise hoop in FIG. 2.

With further reference to FIG. 5, the annular groove (11) is defined radially in the outside surface and has an inner surface. The inner surface of the annular groove (11) may have a top section (11*a*), an upright section (11*b*) and a bottom section (11*c*).

Figure 3:
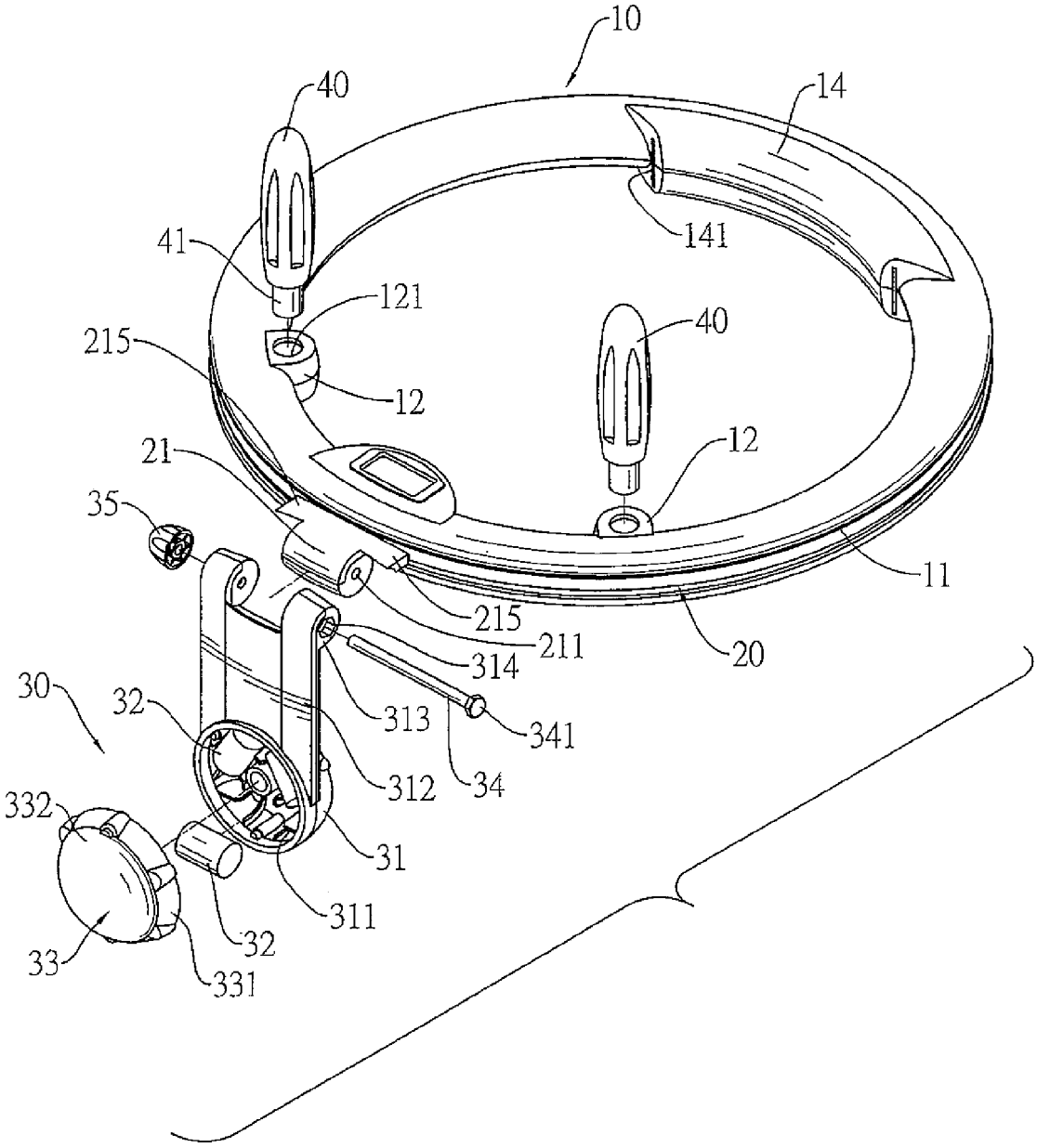
FIG. 3 is a partially exploded perspective view of the exercise hoop in FIG. 2.

With further reference to FIG. 3, the at least one handle mount (12) is formed on the inside surface and each handle mount (12) and has a mounting hole (121) defined uprightly through the handle mount (12).

The belt mount (14) is curved, is formed on the inside surface and has a belt hole (141) defined through the belt mount (14).

The waist belt (15) is mounted on the outer loop (10), may be mounted through the belt hole (141) of the belt mount (14) and may be tightened around a person's waist to allow the person to convey movement to the outer loop.

The control panel (16) is mounted on the outer loop (10) and has a screen (161), a counter (162) and a sensor (163) connected together. The counter (162) may further have number-count and speed-count functions.

Figure 4:
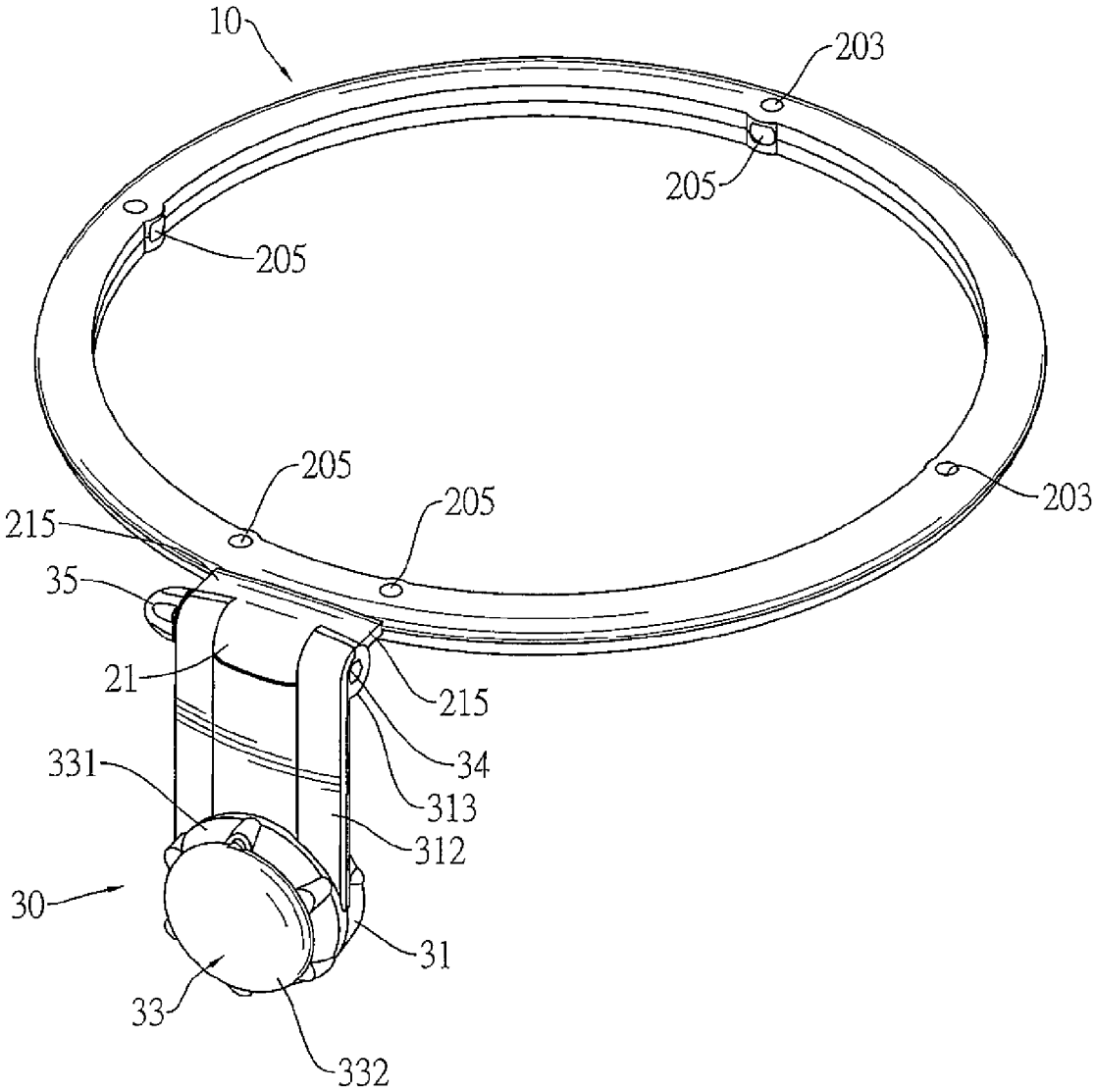
FIG. 4 is a perspective view of an inner loop and the adjustable centrifugal weight assembly of the exercise hoop in FIG. 2.

With further reference to FIG. 4, the inner loop (20) is annular and hollow, is mounted rotatably in the annular groove (11) of the outer loop (10), has an outside surface, a channel (201), multiple sets of through holes (203) and multiple bearings (205) and may further have a connecting bracket (21) and a sensed element (200).

The channel (201) is annular and defined in the inner loop (20).

The through holes (203) are defined radially through the inner loop (20), communicate with the channel (201), three through holes (203) may be implemented in each set of through holes (203) and respectively face the top section (11*a*), the upright section (11*b*) and the bottom section (11*c*) of the inner surface of the annular groove (11) of the outer loop (10).

The bearings (205) may be balls, are mounted rotatably in the channel (201), correspond respectively to the sets of the through holes (203) and contact the inner surface of the annular groove (11) of the outer loop (10). Each bearing (205) protrudes partially out of the through holes (203) of a corresponding set and contacts the inner surface of the annular groove (11) and may contact the top section, upright section and bottom section of the inner surface.

The connecting bracket (21) is formed on the outside surface of the inner loop (20) and may have a pivot hole (211) and two opposite angle limits (215). The pivot hole (211) is defined through the connecting bracket (21). The angle limits (215) are formed on the connecting brackets (21).

The sensed element (200) is mounted on the inner loop (20) and is selectively sensed by the sensor (163) of the inner loop (10). The sensor (163) sensing the sensed element (200) transmits a signal to and activates the counter (162). The counter (162) then counts and conveys the number or speed of revolution to the screen (161).

Figure 6:
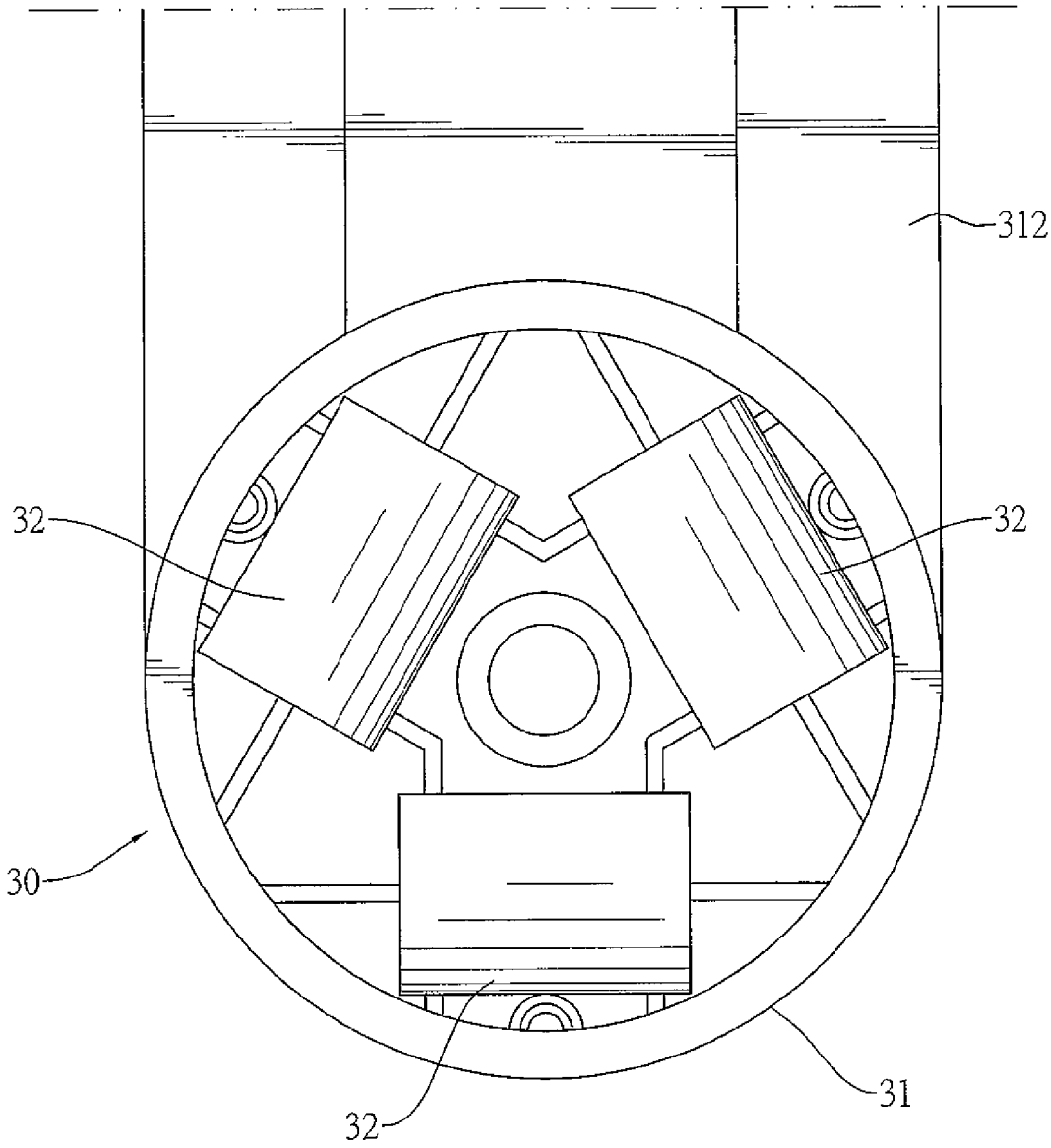
FIG. 6 is an enlarged front view of the adjustable centrifugal weight assembly of the exercise hoop in FIG. 2 without a cover.
Figure 7:
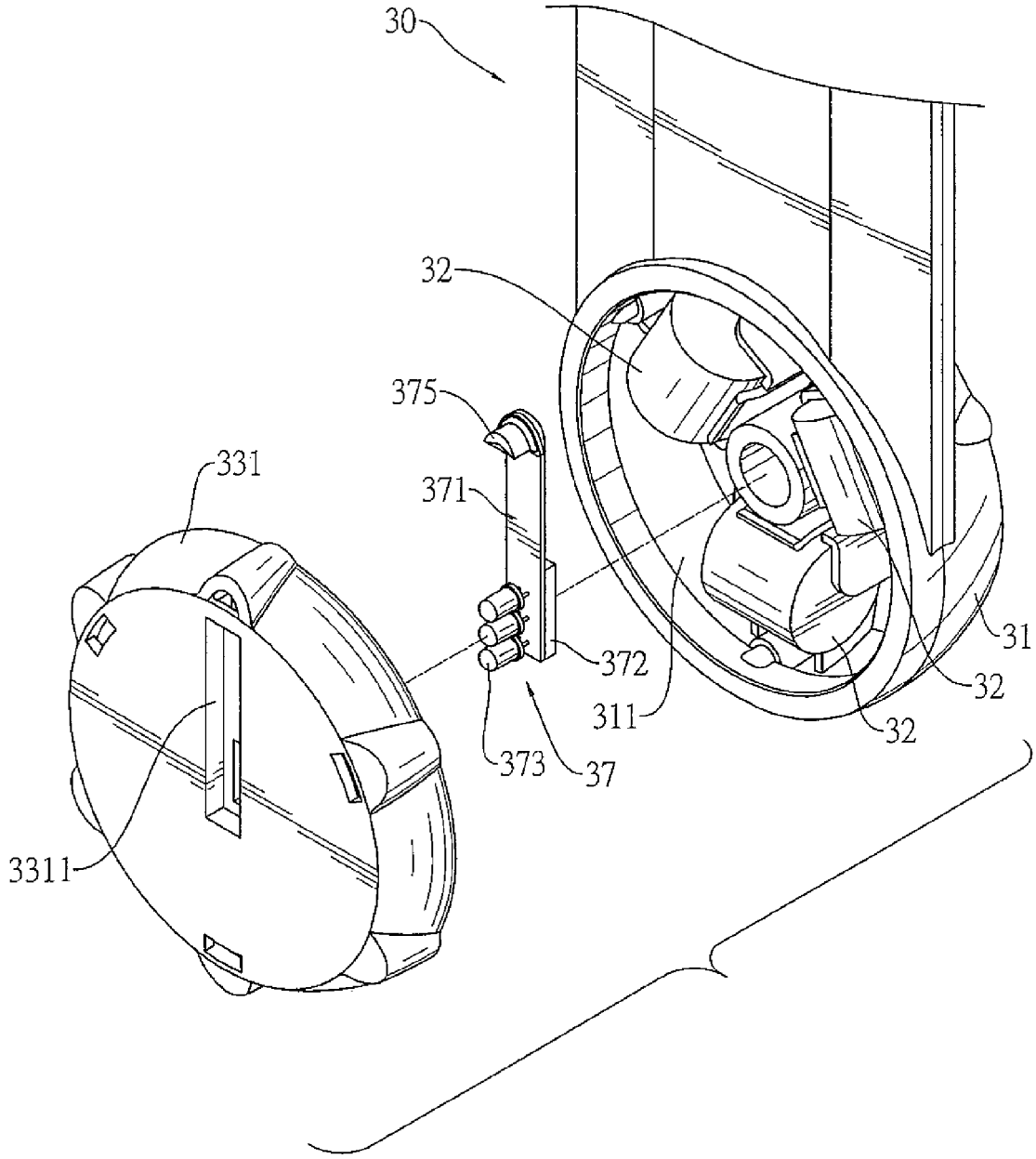
FIG. 7 is an enlarged perspective view of the adjustable centrifugal weight assembly of the exercise hoop in FIG. 6 without a window of a lid of the cover.

With further reference to FIGS. 6 and 7, the adjustable centrifugal weight assembly (30) is mounted pivotally on the inner loop (21), has a casing (31), at least one weight (32) and a cover (32) and may further have a light assembly (37).

The casing (31) has a cavity (311) and a connecting tab (312). The cavity is defined in the casing (31). The connecting tab (312) is formed on and protrudes from the casing (31), is mounted pivotally on the connecting bracket (21) of the inner loop (20) and has a distal end, a pivot bore (314) and a pintle (34). The pivot bore (314) is defined through the distal end of the connecting tab (312). The pintle (34) is mounted through the pivot hole (211) of the connecting bracket (21) of the inner loop (20) and the pivot bore (314) of the casing (31) and has two ends, a stopper (341) and a fastener (35). The stopper (341) is formed on one end. The fastener (35) is mounted on the other end. The pintle may be threaded and the fastener (35) may be a nut.

In a preferred embodiment, two of the sets of the through holes (203) are located respectively adjacent to the angle limits (215) of the connecting bracket (21) of the inner loop (20). Therefore, two of the bearings (205) corresponding respectively to the two sets of through holes (203) may evenly share the load from the adjustable weight assembly (30) to reduce torsion of the adjustable weight assembly (30) when the exercise hoop is in operation.

The at least one weight (32) is mounted detachably in the cavity (311) of the casing (31).

Figure 8:
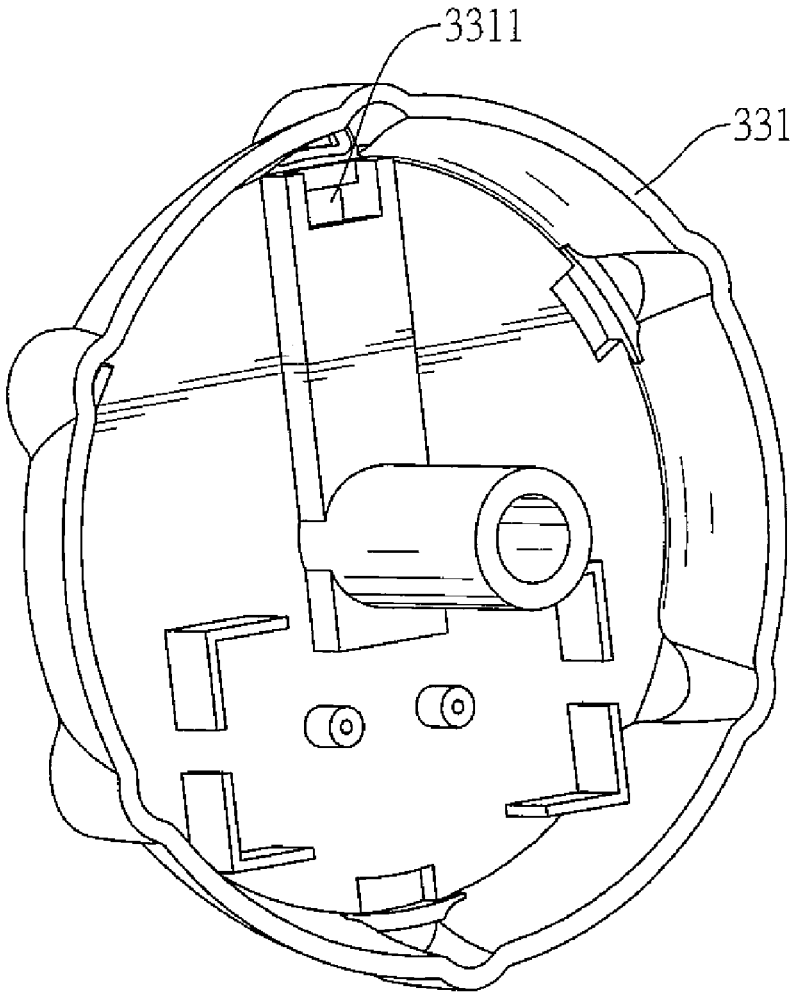
FIG. 8 is a perspective view of a bracket of the cover of the adjustable centrifugal weight assembly of the exercise hoop in FIG. 7.

With further reference to FIG. 8, the cover (33) detachably covers the cavity (311) of the casing (31) and may have a bracket (331) and a lid (332). The bracket (331) detachably covers the cavity (311) and has a mounting slot (3311) defined in the bracket (3311). The lid (332) may be transparent or translucent and is mounted on the bracket (331).

The light assembly (37) is mounted in the cover (33) and has a chassis (371), a printed circuit board (PCB) (372), at least one lighting element (373) and a press button (375). The chassis (371) is mounted in the mounting slot (3311) of the bracket (331). The PCB (372) is mounted on the chassis (371). The at least one lighting element (373) may be light emitting diodes, is mounted on the chassis (371) and is connected to the PCB (372). The press button (373) is mounted on the chassis (371), protrudes out of the bracket (331) and is connected to the PCB (372) to selectively activate the at least one lighting element (373).

The at least one handle (40) is mounted on the outer loop (10), may be mounted respectively on the at least one handle mount (12) and each handle (40) has a bottom end and a mounting post (41) mounted in the mounting hole (121) of one of the at least one handle mount (12).

When using the exercise hoop, the waist belt (15) is placed around the person's waist and the handle (40) gripped. The person sways to rotate the inner loop (20) relative to the outer loop (10). The weight (32) of the adjustable centrifugal weight assembly (30) on the rotating inner loop (30) generates a centrifugal force so that the casing (30) may pivot during rotation allowing the person to identify their level of effort by judging how the casing (30) pivots.

The exercise hoop has following advantages.

1. The adjustable centrifugal weight assembly (30) may increase the person's exercise load so exercising with the exercise hoop is more efficient than using conventional exercise hoops.

2. The weights (32) may be increased or decreased depending on different users. A beginner may use less weights (32) and a skilled user may use more.

3. Gripping the at least one handle (40) or using the waist belt (15) prevents the exercise hoop from falling off.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An exercise hoop comprising:

an outer loop;

an inner loop mounted rotatably in the outer loop; and an adjustable centrifugal weight assembly connected pivotally to the inner loop; wherein the outer loop has an outside surface, an inside surface and an annular groove defined radially in the outside surface and having an inner surface; and the inner loop is mounted rotatably in the annular groove of the outer loop and has an outside surface;

a channel being annular and defined in the inner loop;

multiple sets of through holes defined radially through the inner loop and communicating with the channel; and multiple bearings mounted rotatably in the channel, corresponding respectively to the sets of the through holes, contacting the inner surface of the annular groove of the outer loop and each bearing protruding partially out of the through holes of a corresponding set and contacting the inner surface of the annular groove.

2. The exercise hoop as claimed in claim 1, wherein the outer loop further has a waist belt mounted on the outer loop.

3. The exercise hoop as claimed in claim 2, wherein the outer loop further has at least one handle mounted on the outer loop.

4. The exercise hoop as claimed in claim 1, wherein the inner loop further has a connecting bracket formed on the outside surface of the inner loop; and the adjustable centrifugal weight assembly has a casing having a cavity defined in the casing; and a connecting tab formed on and protruding from the casing, mounted pivotally on the connecting bracket of the inner loop and having a distal end;

at least one weight mounted detachably in the cavity of the casing; and a cover detachably covering the cavity of the casing.

5. The exercise hoop as claimed in claim 1, wherein the connecting bracket of the inner loop has a pivot hole defined through the connecting bracket; and the connecting tab further has a pivot bore defined through the distal end; and a pintle mounted through the pivot hole of the connecting bracket of the inner loop and the pivot bore and having two ends;

a stopper formed on one end; and a fastener mounted on the other end.

6. The exercise hoop as claimed in claim 2, wherein the outer loop further has a belt mount formed on the inside surface of the outer loop and having a belt hole defined through the belt mount; and the belt is mounted through the belt hole.

7. The exercise hoop as claimed in claim 3, wherein the outer loop further has at least one handle mount formed on the inside surface and each handle mount having a mounting hole defined through the handle mount; and each handle has a bottom end and a mounting post mounted in the mounting hole of one of the at least one handle mount.

8. The exercise hoop as claimed in claim 7, wherein the outer loop further has a control panel mounted on the outer loop and having a screen, a counter and a sensor connected together; and the inner loop further has a sensed element mounted on the inner loop and selectively sensed by the sensor of the inner loop.

9. The exercise hoop as claimed in claim 8, wherein the cover has a bracket detachably covering the cavity of the casing and having a mounting slot defined in the bracket; and a lid is mounted on the bracket; and the adjustable centrifugal weight assembly further has a light assembly mounted in the cover and having a chassis mounted in the mounting slot of the bracket;

a printed circuit board (PCB) mounted on the chassis;

at least one lighting element mounted on the chassis and connected to the PCB; and a press button mounted on the chassis, protruding out of the bracket and connected to the PCB to selectively activate the at least one lighting element.

* * * * *